US011542663B2

(12) United States Patent
Swinicki et al.

(10) Patent No.: US 11,542,663 B2
(45) Date of Patent: Jan. 3, 2023

(54) FIBROUS STRUCTURES COMPRISING ZONES

(71) Applicant: The Procter & Gamble Company, Cincinnati, OH (US)

(72) Inventors: Andrea Swinicki, Hyde Park, OH (US); Cassandra Ann Sepello, Loveland, OH (US); Matthew Steven Ritter, Liberty Township, OH (US); Katie Kristine Glass, Maineville, OH (US); Rachael Eden Walther, Union, KY (US); Guillermo Matias Vidal, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 299 days.

(21) Appl. No.: 16/868,900

(22) Filed: May 7, 2020

(65) Prior Publication Data

US 2020/0362518 A1 Nov. 19, 2020

Related U.S. Application Data

(60) Provisional application No. 62/846,868, filed on May 13, 2019.

(51) Int. Cl.
*D21H 27/02* (2006.01)
*D21H 27/00* (2006.01)
*D21H 27/30* (2006.01)

(52) U.S. Cl.
CPC ..... *D21H 27/02* (2013.01); *D21H 27/002* (2013.01); *D21H 27/30* (2013.01)

(58) Field of Classification Search
CPC ..... D21H 27/02; D21H 27/002; D21H 27/30
USPC ..... 162/116, 117, 352; D5/20
See application file for complete search history.

(56) References Cited

U.S. PATENT DOCUMENTS 3,877,562 A * 4/1975 Shaw ..... B65B 43/26 198/429
2015/0330026 A1* 11/2015 Kien ..... D21H 25/005 162/109

FOREIGN PATENT DOCUMENTS

CA 2271372 A1 11/1999
CA 2950974 A1 11/2015

* cited by examiner

*Primary Examiner* — Eric Hug
(74) *Attorney, Agent, or Firm* — C. Brant Cook

(57) ABSTRACT

Fibrous structures having two or more zones, sanitary tissue products comprising such fibrous structures, and method for making such fibrous structures and/or sanitary tissue products are provided.

18 Claims, 13 Drawing Sheets

FIBROUS STRUCTURES COMPRISING ZONES

FIELD OF THE INVENTION

The present invention relates to fibrous structures, and more particularly to fibrous structure comprising two or more zones, sanitary tissue products comprising such fibrous structures, and method for making such fibrous structures and/or sanitary tissue products.

BACKGROUND OF THE INVENTION

Since an important feature of a consumer's first impression and/or assessment of products, such as sanitary tissue products, is visual, the need to improve the consumer's visual experience with a product, such as a sanitary tissue product, for example toilet tissue is paramount. Known ways to impact the visual experience of a consumer of sanitary tissue products is to impart aesthetics and/or texture, via embossing and/or printing of ink on a surface of the sanitary tissue product and/or fibrous structure making up the sanitary tissue product.

Manufacturers continue to attempt to improve the consumer's visual experience with sanitary tissue products to provide a better experience for the consumer at the time of purchasing and/or at the time of using the sanitary tissue product. A better consumer experience via an improved consumer visual experience with a sanitary tissue product, including one or more fibrous structures within the sanitary tissue product will drive purchase of and/or consumption of the sanitary tissue product including its fibrous structures.

One problem faced by manufacturers of fibrous structures and sanitary tissue products comprising such fibrous structures is how to improve the visual experience of a consumer of the fibrous structures and sanitary tissue products comprising such fibrous structures.

Prior art sanitary tissue products exhibit single zones and/or lack a continuous unified design feature and/or exhibit a design feature that repeats within 5 inches or less in the fibrous structure's MD as shown in the Prior Art FIGS. 1A-1G.

Prior Art FIG. 1A shows a sanitary tissue product having a single zone on its surface.

Prior Art FIG. 1B shows a sanitary tissue product lacking a continuous unified design feature and also lacks a design feature that repeats greater than 5 inches in the fibrous structure's MD.

Prior Art FIG. 1C shows a sanitary tissue product lacking a continuous unified design feature and also lacks a design feature that repeats greater than 5 inches in the fibrous structure's MD.

Prior Art FIG. 1D shows a sanitary tissue product lacking a continuous unified design feature and also lacks a design feature that repeats greater than 5 inches in the fibrous structure's MD.

Prior Art FIG. 1E shows a sanitary tissue product lacking a continuous unified design feature and also lacks a design feature that repeats greater than 5 inches in the fibrous structure's MD.

Prior Art FIG. 1F shows a sanitary tissue product lacking a continuous unified design feature and also lacks a design feature that repeats greater than 5 inches in the fibrous structure's MD.

Prior Art FIG. 1G shows a sanitary tissue product lacking a continuous unified design feature and also lacks a design feature that repeats greater than 5 inches in the fibrous structure's MD.

Accordingly, there is a need for fibrous structures and/or sanitary tissue products comprising such fibrous structures that provide an improved and/or superior visual experience compared to known fibrous structures and/or known sanitary tissue products comprising such known fibrous structures and methods for making same.

SUMMARY OF THE INVENTION

The present invention provides a fibrous structure comprising a surface that comprises one or more design features arranged on the surface using one or more and/or two or more and/or three or more and/or four or more and/or five or more and/or six or more of the Gestalt Principles.

One solution to the problem identified above is to provide fibrous structures and/or sanitary tissue products comprising such fibrous structures that comprise a surface that comprises one or more and/or two or more design features arranged on the surface using one or more and/or two or more and/or three or more and/or four or more and/or five or more and/or six or more of the Gestalt Principles and/or providing a fibrous structure comprising a surface comprising a first zone comprising at least a first portion of a first continuous unified primary design feature, for example a "figure" in Gestalt Principle terms, occupying a part of the surface's surface area and a second zone, for example a "ground" in Gestalt Principle terms, occupying at least a first portion of the remaining part of the surface's surface area not occupied by the first zone.

In one example of the present invention, a fibrous structure comprising a surface comprising one or more, for example two or more design features arranged on the surface such that the surface exhibits one or more and/or two or more and/or three or more and/or four or more and/or five or more and/or six or more of the Gestalt Principles is provided.

In another example of the present invention, a fibrous structure comprising a surface comprising one or more and/or two or more design features arranged on the surface using one or more and/or two or more and/or three or more and/or four or more and/or five or more and/or six or more of the Gestalt Principles is provided.

In another example of the present invention, a fibrous structure comprising a surface comprising a first zone defined by at least a first portion of a first continuous unified primary design feature, for example a "figure" in Gestalt Principle terms, occupying a part of the surface's surface area and a second zone, for example a "ground" in Gestalt Principle terms, defined by at least a first portion of the remaining part of the surface's surface area not occupied by the first zone is provided.

In another example of the present invention, a fibrous structure comprising a surface comprising a first zone defined by one or more portions of a continuous unified design feature, for example a first portion of the continuous unified design feature, occupying at least a first part of the surface's surface area; and a second zone defined by at least a first portion of the remaining part of the surface's surface area not occupied by the first zone is provided. In another example, in addition to the first portion, the first zone may further be defined by at least a second portion of the continuous unified design feature occupying a second part of the surface's surface area different from the first part is provided.

In yet another example of the present invention, a single- or multi-ply sanitary tissue product, for example a toilet tissue, comprising one or more fibrous structures according to the present invention is provided.

In still another example of the present invention, a roll of a single- or multi-ply sanitary tissue product according to the present invention is provided.

In even another example of the present invention, a package, for example wherein the package material may be selected from the group consisting of: film, paperboard, cardboard, compostable materials, biodegradable materials, and mixtures thereof, comprising one or more rolls of single- and/or multi-ply sanitary tissue product according to the present invention is provided.

In even still another example of the present invention, a method for making a fibrous structure according to the present invention, wherein the method comprises the steps of:

a. providing a fibrous structure;
b. imparting, for example embossing and/or printing via ink, one or more and/or two or more design features to a surface of the fibrous structure such that the one or more and/or two or more design features are arranged on the surface using one or more and/or two or more and/or three or more and/or four or more and/or five or more and/or six or more of the Gestalt Principles is provided.

In still yet another example of the present invention, a method for making a fibrous structure according to the present invention, wherein the method comprises the steps of:

a. providing a fibrous structure;
b. imparting, for example embossing and/or printing via ink, a first zone defined by at least a first portion of a first continuous unified primary design feature, for example a "figure" in Gestalt Principle terms, occupying a part of the surface's surface area and a second zone, for example a "ground" in Gestalt Principle terms, defined by at least a first portion of the remaining part of the surface's surface area not occupied by the first zone is provided.

In still yet another example of the present invention, a method for making a fibrous structure according to the present invention wherein the method comprises the steps of:

a. providing a fibrous structure;
b. embossing a surface of the fibrous structure such that the surface comprises:
   i. a first zone defined by at least a first portion of a first continuous unified primary design feature occupying a first part of the surface's surface area; and
   ii. a second zone defined by at least a first portion of the remaining part of the surface's surface area not occupied by the first zone is provided.

Accordingly, the present invention provides novel fibrous structures, sanitary tissue products comprising such fibrous structures, and method for making same as described herein.

DETAILED DESCRIPTION OF THE INVENTION

Definitions

Figure 1A:
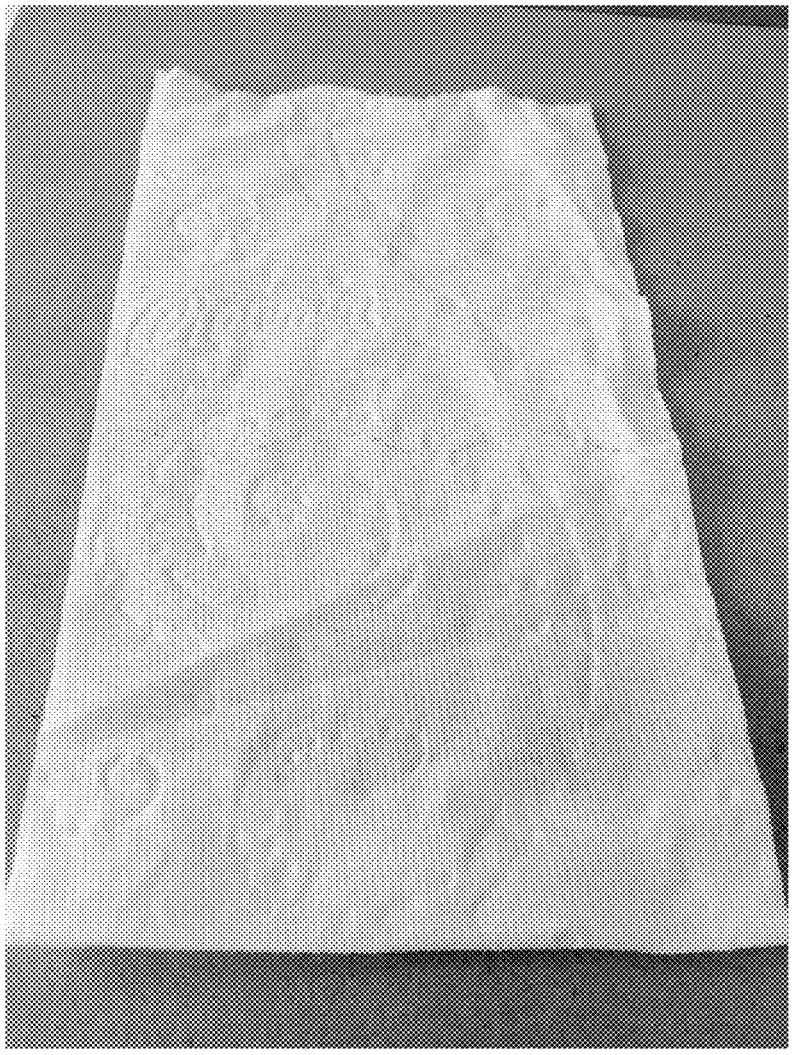
Fig. 1A PRIOR ART
FIG. 1A is a photograph of an example of a Prior Art sanitary tissue product comprising a surface lacking two or more zones according to the present invention.
Figure 1B:
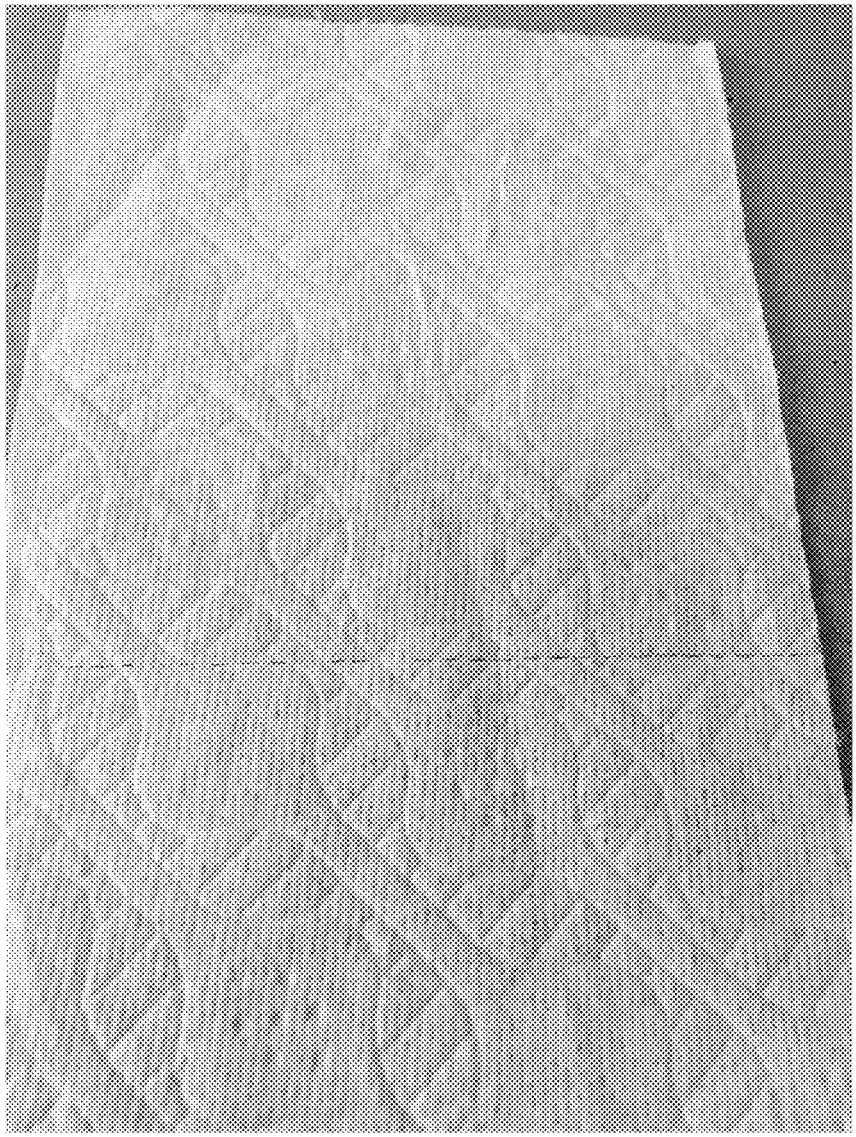
Fig. 1B PRIOR ART
FIG. 1B is a photograph of another example of a Prior Art sanitary tissue product comprising a surface lacking at least a first portion of a first continuous unified design feature according to the present invention.
Figure 1C:
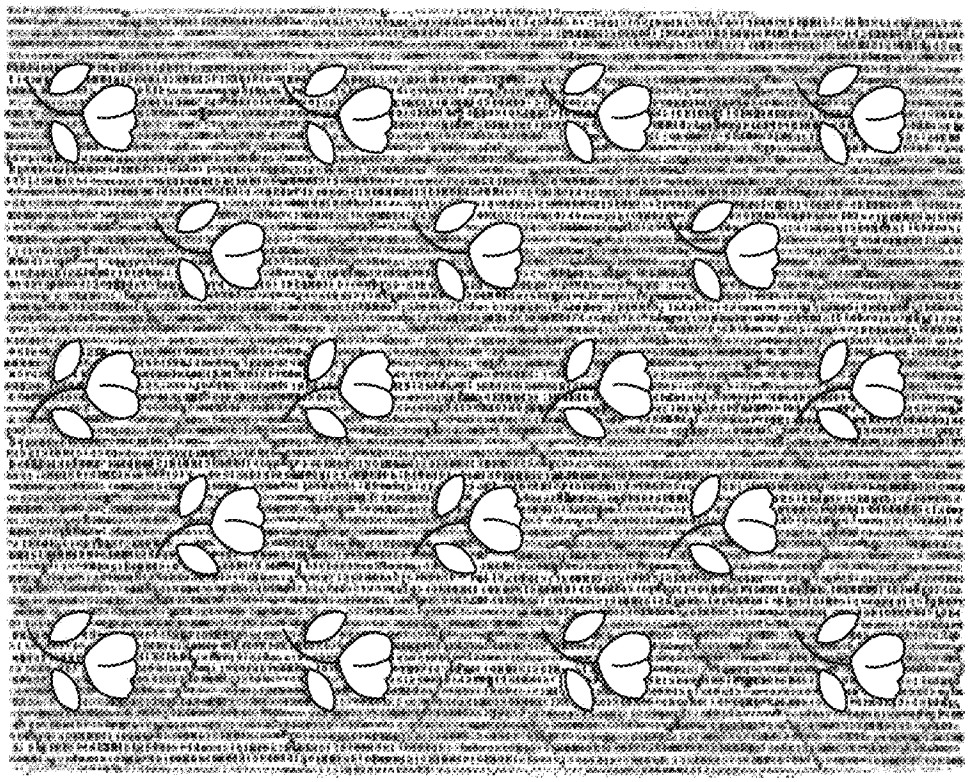
Fig. 1C PRIOR ART
FIG. 1C is a schematic representation of another example of a Prior Art sanitary tissue product comprising a surface lacking at least a first portion of a first continuous unified design feature according to the present invention.
Figure 1D:
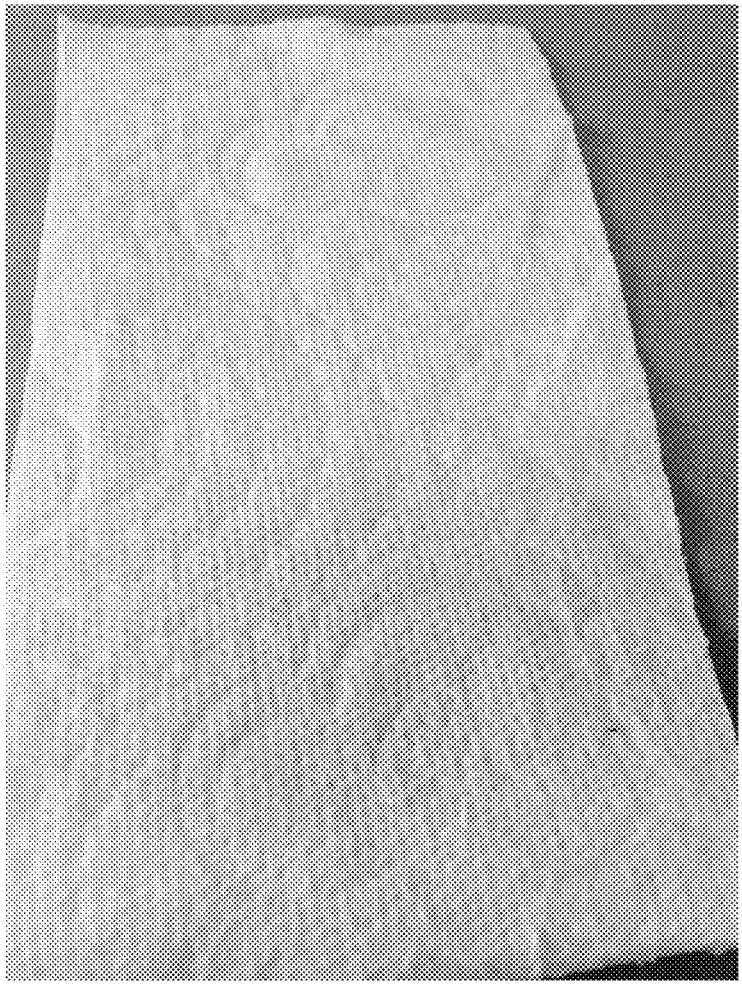
Fig. 1D PRIOR ART
FIG. 1D is a photograph of another example of a Prior Art sanitary tissue product comprising a surface lacking at least a first portion of a first continuous unified design feature according to the present invention.
Figure 1E:
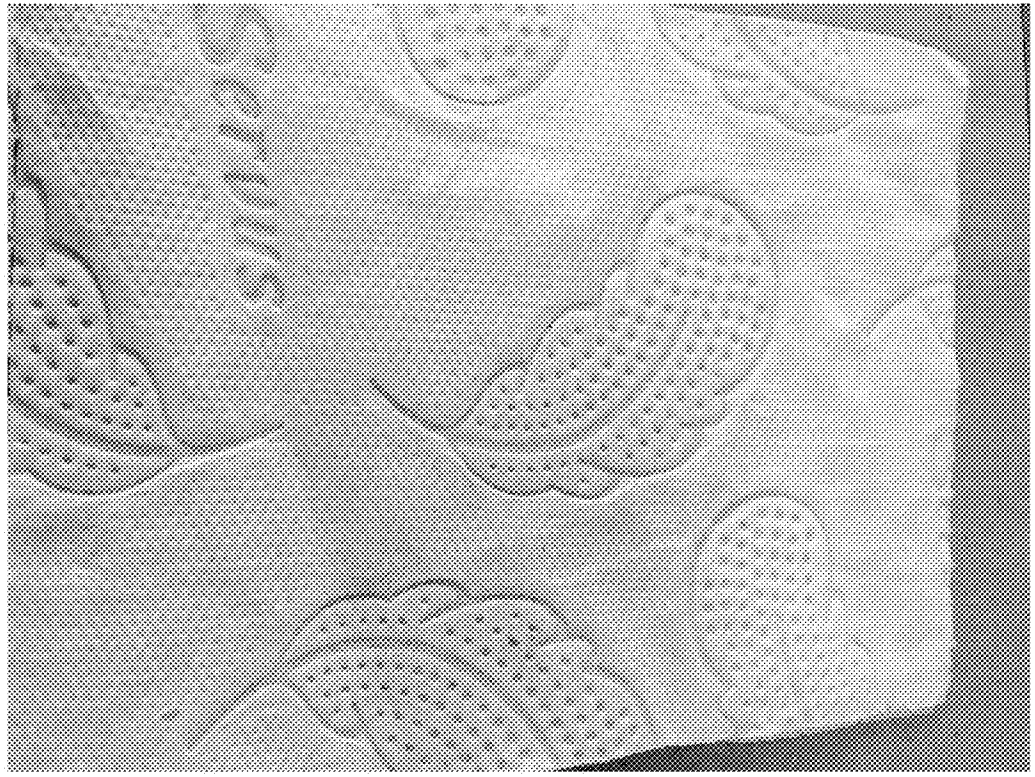
Fig. 1E PRIOR ART
FIG. 1E is a photograph of another example of a Prior Art sanitary tissue product comprising a surface lacking at least a first portion of a first continuous unified design feature according to the present invention.
Figure 1F:
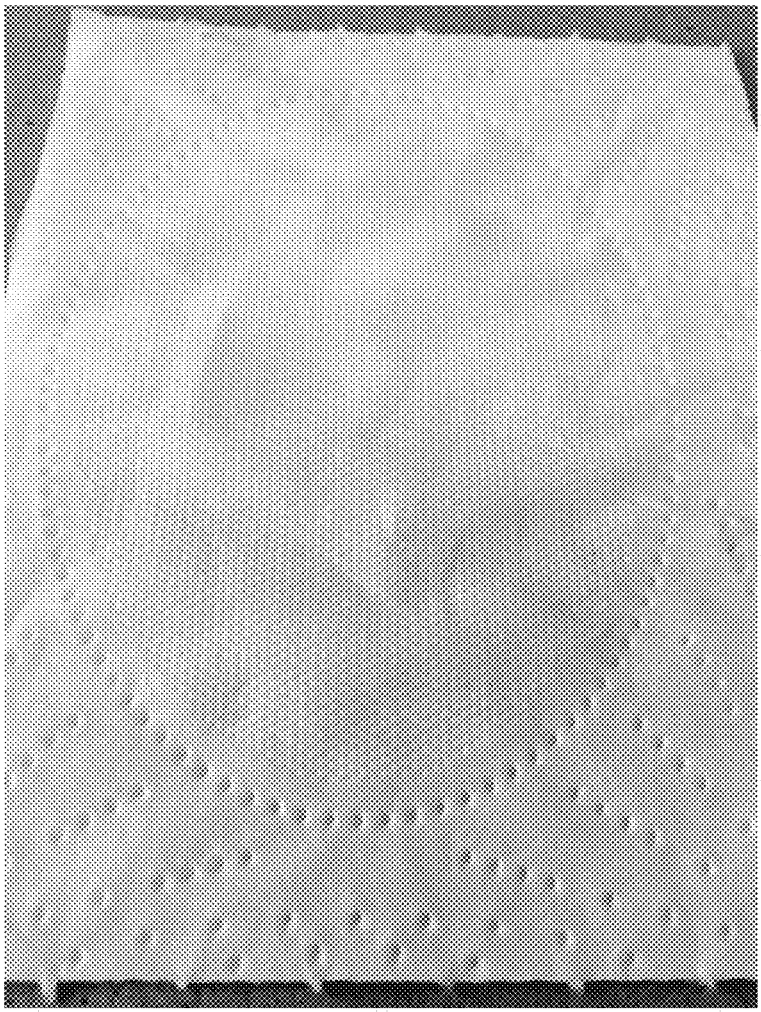
Fig. 1F PRIOR ART
FIG. 1F is a photograph of another example of a Prior Art sanitary tissue product comprising a surface lacking at least a first portion of a first continuous unified design feature according to the present invention.
Figure 1G:
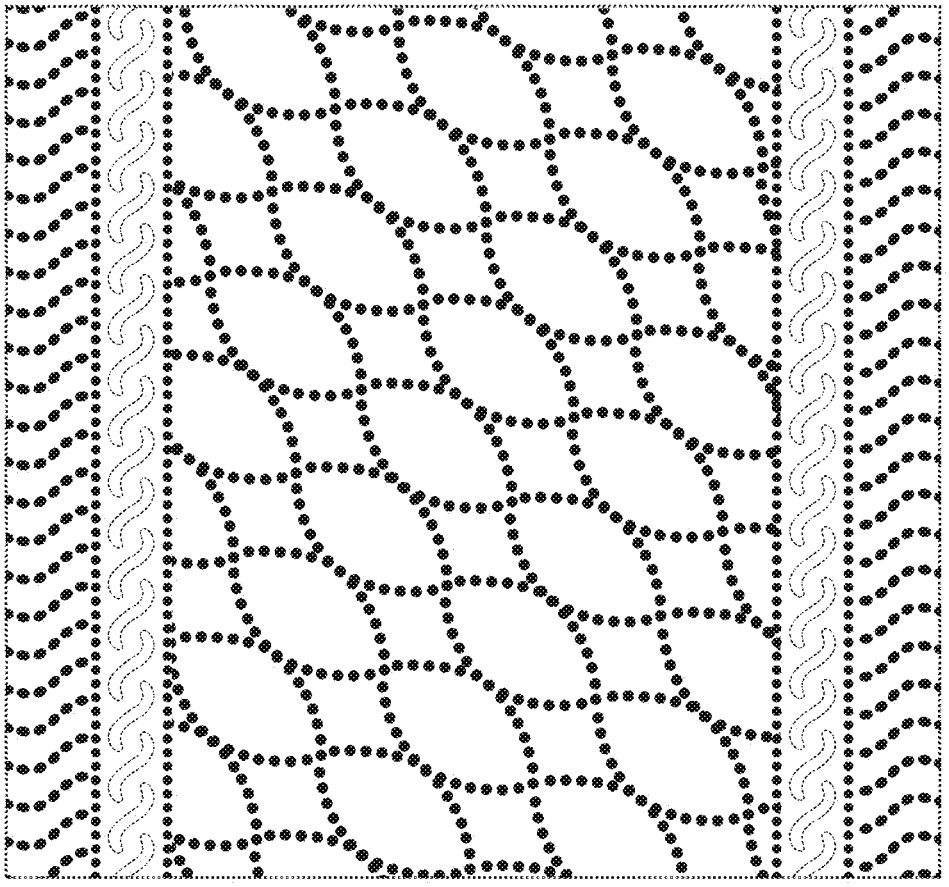
Fig. 1G PRIOR ART
FIG. 1G is a schematic representation of another example of a Prior Art sanitary tissue product comprising a surface lacking at least a first portion of a first continuous unified design feature according to the present invention.

"Gestalt Principles" as used herein means the six common, basic Gestalt Principles; namely, Similarity, Continuation, Closure, Proximity (also known as Grouping), Figure/Ground, and Symmetry/Order. The Gestalt Principles relate to the way in which humans, when looking at groups of things, such as embossments within a first design feature and embossments within a second design feature different from the first design feature, will see the whole or unified whole first rather than seeing the individual parts of a group of things.

These six common, basic Gestalt Principles are talked further below and are described in Sam Hampton-Smith's, "The designer's guide to Gestalt Theory", Dec. 11, 2018, www.creativebloq.com/graphic-design/gestalt-theory-10134960.

"Gestalt Principle Similarity" as used herein means humans will view individual similar elements, such as similar embossments (for example similar in shape and/or size and/or type and/or color and/or texture and/or value) as being part of a pattern or group (for example a design feature).

"Gestalt Principle Continuation" as used herein means a human's eye will be drawn along a path, line, or curve seeing a continuous line rather than separate lines, such as a dashed line or lines or broken line or lines.

"Gestalt Principle Closure" as used herein means the human eye's tendency to see closed shapes rather than incomplete shapes or where an object's interior space is not fully closed because the human perceives a complete shape or object by filling in the missing information.

"Gestalt Principle Proximity" or "Gestalt Principle Grouping" as used herein means individual elements, such as individual embossments, that are closely arranged, such as on a surface of a fibrous structure, will be perceived by a human as being grouped together and/or associated together. In addition, if the individual elements are similar under the Gestalt Principle Similarity, then they may also be perceived as a single whole rather than as separate, individual elements depending on their proximity to one another. In one example, the individual elements, such as individual embossments, do not have to be regular to achieve proximity/grouping. Proximity/grouping may be achieved with different commonality including shape, color, texture, and size.

In one example, proximity can be measured by linear distance and/or angular distance. Linear distance is the minimum distance between two centers of two elements, for example embossments.

"Gestalt Principle Figure/Ground" as used herein means a human's eye sees and separates an object and/or objects, such as a unitary design feature, from its/their surrounding background. A human's eyes want to see the figure (foreground object, such as a unitary design feature, for example the unitary primary design feature) and ground (background) as two different planes of focus. Everything that is not figure, for example not a unitary design feature, is considered ground.

"Gestalt Principle Symmetry/Order" as used herein means that aesthetics and/or texture on a surface, such as a surface of a fibrous structure, should not provide a sense of disorder or imbalance to avoid a human wasting time trying to locate the missing element or fix the problem rather than focusing on the surface as a whole.

"Continuous Unified Design Feature" as used herein means a design feature that combines one or more elements, such as line element embossments and/or dot element embossments, but especially line element embossments, and/or printed elements, to make a single unit design feature that has no terminal ends along its length, especially in the MD or substantially in the MD, in other words is continuous.

"Discontinuous Unified Design Feature" as used herein means a design feature that combines one or more elements, such as line element embossments and/or dot element embossments, and/or printed elements, to make a single unit design feature that has one or more terminal ends along its length.

"Sanitary tissue product", which may be referred to herein as a "web", as used herein means a soft, low density (i.e. < about 0.15 g/cm$^3$) article comprising a web comprising one or more fibrous structure plies according to the present invention, wherein the sanitary tissue product is useful as a wiping implement for post-urinary and post-bowel movement cleaning (toilet tissue), for otorhinolaryngological discharges (facial tissue), and multi-functional absorbent and cleaning uses (absorbent towels).

In one example, the sanitary tissue product is a toilet tissue product (toilet tissue), for example a toilet tissue product that is designed to be flushed down toilets, for example residential toilets, such as tank-type toilets, and to disperse within municipal sewer systems and/or septic systems/tanks. Such a toilet tissue product is void of permanent wet strength and/or levels of permanent wet strength agents, for example polyaminoamide-epichlorohydrin (PAE), which would negatively impact the toilet tissue's decay such that the toilet tissue would exhibit a wet strength decay of 25% or less, more typically a wet strength decay of only about 10-15% during a 30 minute soak test. Such a wet strength decay of 25% or less (typically 10-15%) is unacceptable and undesirable for toilet tissue, which is designed to be flushed down toilets and into septic systems/tanks and/or municipal sewer systems. However, the toilet tissue may comprise a temporary wet strength agent such that the toilet tissue exhibits enough wet strength (temporary wet strength) to meet consumer requirements (doesn't fall apart and/or disperse and/or leak through) during use, for example during the brief time the toilet tissue is wet during use and/or exposed to a relatively small amount of water (not saturated) by a consumer (during wiping, for example after urinating), without causing the toilet tissue to exhibit flushability issues compared to the flushability issues a toilet tissue exhibiting permanent wet strength would encounter. In one example, the toilet tissue of the present invention exhibits a wet strength decay of greater than 60% during a 30 minute soak test (and typically even a wet strength decay of at least 40-60% after 2 minutes during the 30 minute soak test), which is considered "temporary wet strength", due to the concerns of flushability issues. Temporary wet strength in paper, for example toilet issue, is achieved by adding temporary wet strength agents, for example glyoxylated polyacrylamide, to the toilet tissue.

In another example, the sanitary tissue product is a paper towel product (paper towel), for example a paper towel product designed to absorb fluids, such as water, while still remaining intact (not dispersing). Paper towel products are designed to not be flushed down toilets and/or to not disperse when wet. Such a paper towel product comprises permanent wet strength and/or levels of permanent wet strength agents, for example polyaminoamide-epichlorohydrin (PAE), which result in the paper towel's exhibiting a wet strength decay of 25% or less, more typically a wet strength decay of only about 10-15% during a 30 minute soak test.

Toilet tissue that exhibits temporary wet strength when disposed in a toilet due to the toilet bowl's water begins decaying, breaking apart into pieces, and dispersing upon saturation of the toilet tissue. Paper towels, which exhibit permanent wet strength, are not suitable to be flushed in toilets because unlike toilet tissue, which exhibits temporary wet strength, paper towels will not decay, break apart into pieces, and disperse upon saturation of the paper towel resulting in the toilet being clogged and/or pipes, septic tank, and municipal sewer systems being "clogged" by the intact paper towel. One reason paper towels require permanent wet strength is that consumers may reuse and rewet a paper towel during use. As result of the issues associated with having permanent wet strength in toilet tissue (bath tissue), one of ordinary skill in the art understands that all bath tissue grades should never include a level of permanent wet strength agent that would result in the toilet tissue (bath tissue) exhibiting permanent wet strength and thus resulting in flushability issues, such as issues with dispersing and/or very low wet strength decay properties.

The sanitary tissue products of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$ as measured according to the respective Basis Weight Test Method described herein. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the respective Basis Weight Test Method described herein.

The sanitary tissue products, for example toilet tissue products, of the present invention may exhibit a sum of MD and CD dry tensile strength of greater than about 59 g/cm (150 g/M) and/or from about 78 g/cm to about 394 g/cm and/or from about 98 g/cm to about 335 g/cm as measured according to the respective Dry Tensile Strength Test Method described herein. In addition, the sanitary tissue products, for example toilet tissue products, of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm as measured according to the respective Dry Tensile Strength Test Method described herein. In one example, the sanitary tissue products, for example toilet tissue products, of the present invention exhibit a sum of MD and CD dry tensile strength of less than about 394 g/cm and/or less than about 335 g/cm as measured according to the respective Dry Tensile Strength Test Method described herein.

In another example, the sanitary tissue products, for example paper towel products, of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 787 g/cm as measured according to the respective Dry Tensile Strength Test Method described herein.

The sanitary tissue products, for example toilet tissue products, of the present invention may exhibit an initial sum of MD and CD wet tensile strength of less than about 78 g/cm and/or less than about 59 g/cm and/or less than about 39 g/cm and/or less than about 29 g/cm as measured according to the Wet Tensile Test Method described herein.

The sanitary tissue products, for example paper towel products, of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm as measured according to the Wet Tensile Test Method described herein.

The sanitary tissue products of the present invention may exhibit a density (based on measuring caliper at 95 g/in$^2$), which may be referred to as a sheet density or web density to distinguish it from the sanitary tissue product roll's Roll Density, of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue product, for example toilet tissue product, may exhibit a sum of MD and CD dry tensile of less than 1000 g/in and/or less than 900 g/in and/or less than 800 g/in and/or less than 750 g/in and/or less than 700 g/in and/or less than 650 g/in and/or less than 600 g/in and/or less than 550 g/in and/or greater than 250 g/in and/or greater than 300 g/in and/or greater than 350 g/in and/or less than 1000 g/in to about 250 g/in and/or less than 900 g/in to about 300 g/in and/or less than 800 g/in to about 400 g/in.

The sanitary tissue product, for example paper towel product, may exhibit a sum of MD and CD dry tensile of greater than 1500 g/in and/or greater than 1750 g/in and/or greater than 2000 g/in and/or greater than 2100 g/in and/or greater than 2200 g/in and/or greater than 2300 g/in and/or greater than 2400 g/in and/or greater than 2500 g/in and/or less than 5000 g/in and/or less than 4000 g/in and/or less than 3500 g/in and/or greater than 1500 g/in to about 5000 g/in and/or greater than 1750 g/in to about 4000 g/in and/or greater than 1750 g/in to about 3500 g/in.

The sanitary tissue product rolls of the present invention may exhibit a Roll Compressibility of from about 0.5% to about 8.0% and/or from about 0.5% to about 6.0% and/or from about 0.7% to about 4.0% and/or from about 0.7% to about 3.0% and/or from about 1.0% to about 2.5% and/or from about 1.0% to about 2.0% as measured according to the Percent Compressibility Test Method described herein. The rolled sanitary tissue products of the present disclosure may exhibit a roll compressibility of less than 8.0% and/or less than 6.0% and/or less than 4.0% and/or less 3.0% and/or less than 2.5% and/or less than 2.0% and/or greater than 0.0% and/or greater than 0.2% and/or greater than 0.5% and/or greater than 0.7% and/or greater than 1.0% as measured according to the Percent Compressibility Test Method described herein.

The sanitary tissue products (e.g., toilet tissue products) of the present disclosure may exhibit a geometric mean peak elongation of greater than 10%, and/or greater than 15%, and/or greater than 20%, and/or greater than 25%, as measured according to the respective Dry Tensile Strength Test Method described herein.

The sanitary tissue products (e.g., toilet tissue products) of the present disclosure may exhibit a geometric mean dry tensile strength of greater than about 200 g/in, and/or greater than about 250 g/in, and/or greater than about 300 g/in, and/or greater than about 350 g/in, and/or greater than about 400 g/M, and/or greater than about 500 g/M, and/or greater than about 750 g/M, as measured according to the respective Dry Tensile Strength Test Method described herein.

The sanitary tissue products (e.g., toilet tissue products) of the present disclosure may exhibit a geometric mean modulus of less than about 20,000 g/cm, and/or less than about 15,000 g/cm, and/or less than about 10,000 g/cm, and/or less than about 5,000 g/cm, and/or less than about 3,000 g/cm, and/or less than about 1,500 g/cm, and/or less than about 1,200 g/cm, and/or between about 1,200 g/cm and about 0 g/cm, and/or between about 1,200 g/cm and about 700 g/cm, as measured according to the respective Dry Tensile Strength Test Method described herein.

The sanitary tissue products (e.g., toilet tissue products) of the present disclosure may exhibit a CD elongation of greater than about 8%, and/or greater than about 10%, and/or greater than about 12%, and/or greater than about 15%, and/or greater than about 20%, as measured according to the respective Dry Tensile Strength Test Method described herein. Further, the sanitary tissue products (e.g., toilet tissue products) of the present disclosure may exhibit a CD elongation of from about 8% to about 20%, or from about 10% to about 20%, or from about 10% to about 15%, as measured according to the respective Dry Tensile Strength Test Method described herein.

The sanitary tissue products (e.g., toilet tissue products) of the present disclosure may exhibit a dry burst of less than about 660 g, and/or from about 100 g to about 600 g, as measured according to the Dry Burst Test Method described herein. In another example, the sanitary tissue products (e.g., toilet tissue products) of the present disclosure may exhibit a dry burst of greater than about 100 g, and/or from about 100 g to about 1000 g, and/or from about 100 g to about 600 g, as measured according to the Dry Burst Test Method described herein.

The paper towel products of the present disclosure may exhibit a wet burst strength of greater than about 270 grams, in another form from about 290 g, about 300 g, or about 315 g to about 360 g, about 380 g, or about 400 g as measured according to the Wet Burst Test Method described herein.

The toilet tissue products of the present disclosure may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in) and/or less than about 23 g/cm (60 g/in) and/or less than about 20 g/cm (50 g/in) and/or about less than about 16 g/cm (40 g/cm) as measured according to the Wet Tensile Test Method described herein. In addition, the paper towel products of the present disclosure may exhibit an initial total wet tensile strength ("ITWT") of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in) as measured according to the Wet Tensile Test Method described herein.

Furthermore, the paper towel products of present disclosure may exhibit an initial total wet tensile strength of less than about 800 g/25.4 mm and/or less than about 600 g/25.4 mm and/or less than about 450 g/25.4 mm and/or less than about 300 g/25.4 mm and/or less than about 225 g/25.4 mm as measured according to the Wet Tensile Test Method described herein.

The toilet tissue products of the present invention may exhibit a decayed initial total wet tensile strength at 30 minutes of less than about 39 g/cm (100 g/in) and/or less than about 30 g/cm (75 g/in) and/or less than about 20 g/cm (50 g/in) and/or less than about 16 g/cm (40 g/in) and/or less than about 12 g/cm (30 g/in) and/or less than about 8 g/cm (20 g/in) and/or less than about 4 g/cm (10 g/in) as measured according to the Wet Tensile Test Method described herein.

The sanitary tissue products and/or webs of the present invention may exhibit a caliper of from about 5 mils to about 50 mils and/or from about 7 mils to about 45 mils and/or from about 10 mils to about 40 mils and/or from about 12 mils to about 30 mils and/or from about 15 mils to about 28 mils as measured according to the Caliper Test Method described herein.

The web may comprise a structured web, for example a web comprising at least one 3D patterned fibrous structure ply, for example a through-air-dried web, such as a creped through-air-dried fibrous structure ply and/or an uncreped through-air-dried fibrous structure ply.

The web may comprise a creped fibrous structure ply, for example a fabric creped fibrous structure ply and/or a belt creped fibrous structure ply and/or a conventional wet pressed fibrous structure ply.

The web may comprise through-air-dried (creped or uncreped) fibrous structures, belt creped fibrous structures, fabric creped fibrous structures, NTT fibrous structures, ATMOS fibrous structures, conventional wet pressed fibrous structures, and mixtures thereof.

The web may comprise an embossed fibrous structure ply.

The web may be a wet-laid web and/or an air-laid web.

The webs and/or sanitary tissue products of the present invention may comprise a surface softening agent or be void of a surface softening agent. In one example, the sanitary tissue product is a non-lotioned sanitary tissue product, such as a sanitary tissue product comprising a non-lotioned fibrous structure ply, for example a non-lotioned through-air-dried fibrous structure ply, for example a non-lotioned creped through-air-dried fibrous structure ply and/or a non-lotioned uncreped through-air-dried fibrous structure ply. In yet another example, the sanitary tissue product may comprise a non-lotioned fabric creped fibrous structure ply and/or a non-lotioned belt creped fibrous structure ply.

The webs and/or sanitary tissue products of the present invention may comprise trichome fibers and/or may be void of trichome fibers.

The sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

In one example, the sanitary tissue products, for example paper towel products, of the present invention exhibits permanent wet strength, for example the sanitary tissue products comprise a permanent wet strength agent, such as a level of permanent wet strength agent such that the sanitary tissue products exhibit a wet strength decay of less than 25% and/or less than 20% and/or less than 15% and/or from about 5% to about 25% and/or from about 5% to about 20% and/or from about 10% to about 15% during a 30 minute soak test.

In one example, the sanitary tissue products, for example toilet tissue products, of the present invention are void of permanent wet strength, for example the sanitary tissue products exhibit a wet strength decay of greater than 60% and/or greater than 65% and/or greater than 70% and/or greater than 75% and/or greater than 80% during a 30 minute soak test and/or greater than 40% and/or greater than 45% and/or greater than 50% and/or greater than 55% and/or greater than 60% after 2 minutes during the 30 minute soak test. In one example, the sanitary tissue products, for example toilet tissue products, comprise a temporary wet strength agent, for example a level of temporary wet strength agent, such that the sanitary tissue products exhibit the wet strength decay described immediately above.

"Web" and/or "fibrous structure" and/or "fibrous structure ply" as used herein means a structure that comprises a plurality of pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments) and/or hydroxyl polymer filaments, for example polyvinyl alcohol filaments and/or polysaccharide filaments such as starch filaments. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes, for example conventional wet-pressed papermaking processes and through-air-dried papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, often referred to as a parent roll, and may subsequently be converted into a finished product, e.g. a single- or multi-ply sanitary tissue product.

The fibrous structures of the present invention may be homogeneous or may be layered. If layered, the fibrous structures may comprise at least two and/or at least three and/or at least four and/or at least five layers of fiber and/or filament compositions.

In one example, the fibrous structure of the present invention consists essentially of fibers, for example pulp fibers, such as cellulosic pulp fibers and more particularly wood pulp fibers, such as 100% of the fibers present in the fibrous structure are pulp fibers, such as cellulosic pulp fibers and more particularly wood pulp fibers.

In another example, the fibrous structure of the present invention comprises fibers and is void of filaments.

In still another example, the fibrous structures of the present invention comprise filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristle-like outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc.), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Basis Weight" as used herein is the weight per unit area of a sample reported in lbs/3000 $ft^2$ or $g/m^2$ (gsm) and is measured according to the respective Basis Weight Test Method described herein.

"Machine Direction" or "MD" as used herein means the direction parallel to the flow of the fibrous structure through the web (fibrous structure) making machine and/or sanitary tissue product manufacturing equipment.

"Cross Machine Direction" or "CD" as used herein means the direction parallel to the width of the web (fibrous structure) making machine and/or sanitary tissue product manufacturing equipment and perpendicular to the machine direction.

"Ply" as used herein means an individual, integral web (fibrous structure).

"Plies" as used herein means two or more individual, integral webs (fibrous structures) disposed in a substantially contiguous, face-to-face relationship with one another, forming a multi-ply fibrous structure and/or multi-ply sanitary tissue product. It is also contemplated that an individual, integral web (fibrous structure) can effectively form a multi-ply fibrous structure, for example, by being folded on itself.

"Embossed" as used herein with respect to a web and/or sanitary tissue product means that a web and/or sanitary tissue product of the present invention has been subjected to a process which converts a smooth surfaced web and/or sanitary tissue product to a decorative surface by replicating a design on one or more emboss rolls, which form a nip through which the web and/or sanitary tissue product passes. Embossed does not include creping, microcreping, printing or other processes that may also impart a texture and/or decorative pattern to a web and/or sanitary tissue product.

"Differential density", as used herein, means a web and/or sanitary tissue product of the present invention that comprises one or more regions of relatively low fiber density, which are referred to as pillow regions, and one or more regions of relatively high fiber density, which are referred to as knuckle regions.

"Densified", as used herein means a portion of a web and/or sanitary tissue product of the present invention that is characterized by regions of relatively high fiber density (knuckle regions).

"Non-densified", as used herein, means a portion of a web and/or sanitary tissue product of the present invention that exhibits a lesser density (one or more regions of relatively lower fiber density) (pillow regions) than another portion (for example a knuckle region) of the web and/or sanitary tissue product.

"Creped" as used herein means creped off of a Yankee dryer or other similar roll and/or fabric creped and/or belt creped. Rush transfer of a web (fibrous structure) alone does not result in a "creped" fibrous structure or "creped" sanitary tissue product for purposes of the present invention.

Fibrous Structure Surface

Figure 2:
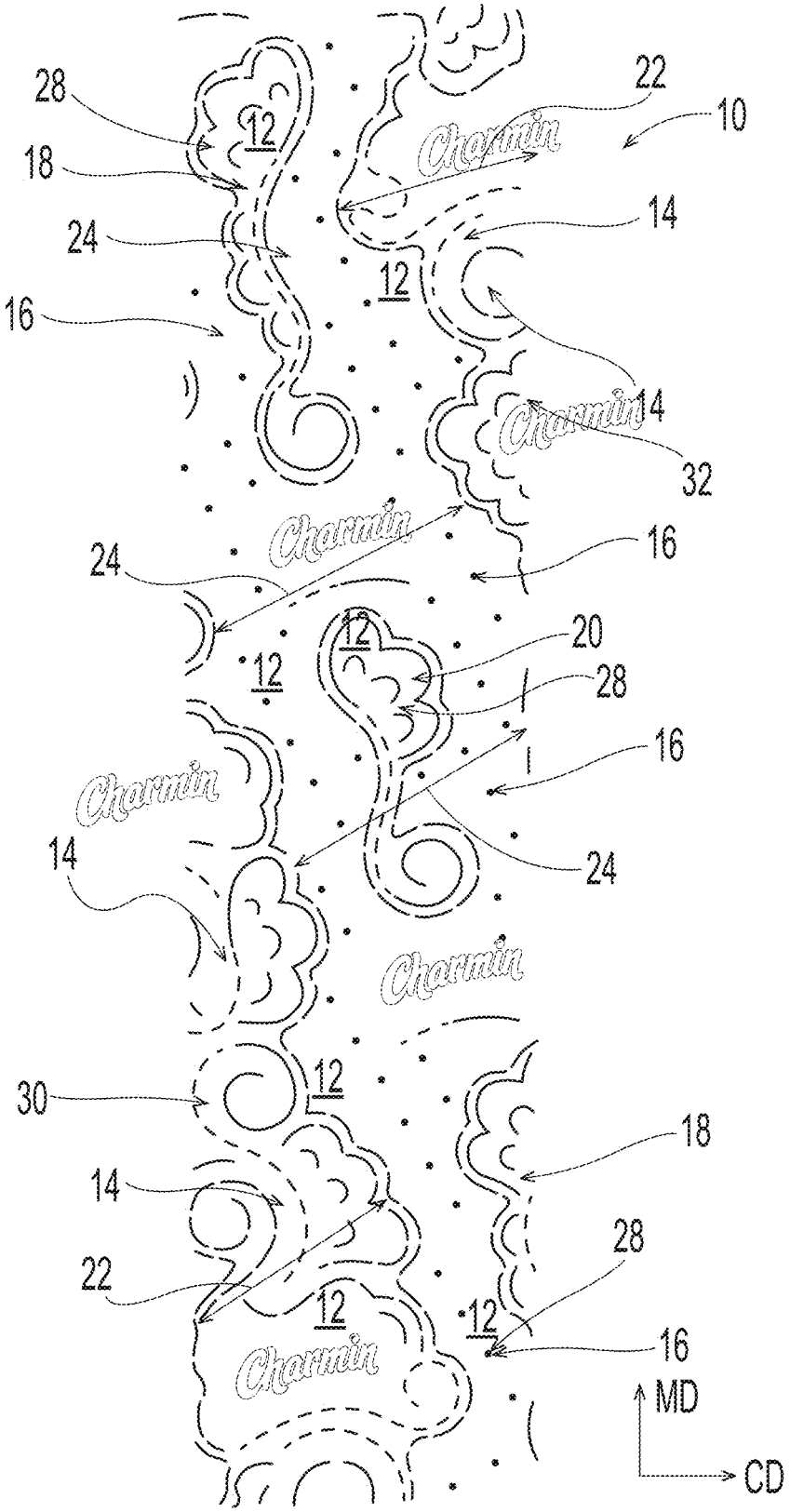
FIG. 2 is a schematic representation of an example of a fibrous structure according to the present invention.
Figure 3:
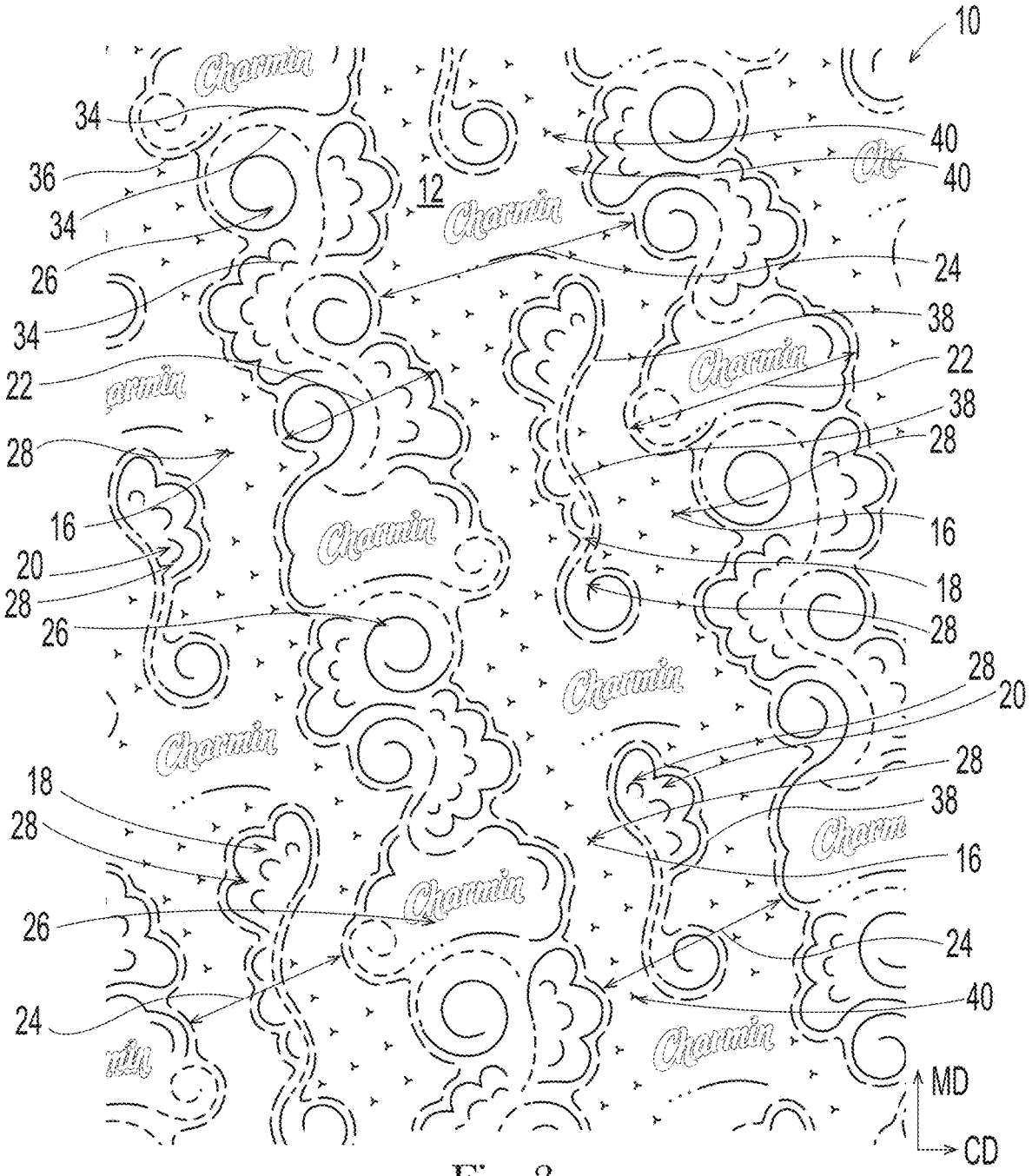
FIG. 3 is a schematic representation of a broader field of view of the aesthetics present on the fibrous structure shown in FIG. 2.
Figure 4:
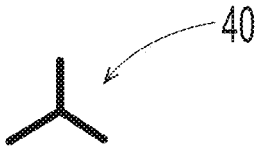
FIG. 4 is a schematic representation of an example of a discontinuous unified design feature.
Figure 5:
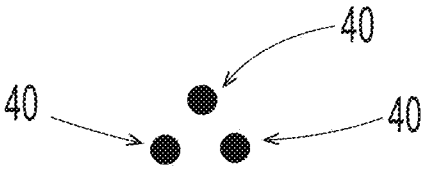
FIG. 5 is a schematic representation of another example of a discontinuous unified design feature.

As shown in FIGS. 2 and 3, a fibrous structure 10 according to the present invention comprises a surface 12 comprising an aesthetic and/or texture that exhibits one or more and/or two or more and/or three or more and/or four or more and/or five or more and/or six or more Gestalt Principles. The surface 12 of the fibrous structure 10 comprises one or more, for example two or more design features (four or more in this example) 14, 16, 18, 20 arranged on the surface 12 such that the surface 12 exhibits one or more and/or two or more and/or three or more and/or four or more and/or five or more and/or six or more of the Gestalt Principles.

The surface 12 of the fibrous structure 10 as shown in FIGS. 2 and 3 comprises two or more zones, a first zone 22 and a second zone 24, for example two or more embossed zones that differ from each other. Each of the zones, first zone 22 and second zone 24, may vary in shape and/or width along their respective lengths. Further, a visibly discernible boundary between the first zone 22 and the second zone 24 exists. The first zone 22 is defined by a Gestalt Principle Figure, in this case a continuous unified design feature 26, which may in one example be an embossed and/or printed via ink design feature, that occupies a part of the surface's 12 surface area and a second zone 24, for example a Gestalt Principle Ground, defined by at least a portion of the remaining part of the surface's 12 surface area not occupied by the first zone 22. In one example, the first zone 22 and/or continuous unified design feature 26 comprises ink. In one example, the first zone 22 consists of and is defined by a continuous unified design feature 26. The first zone 22 may be present on two or more different portions of the surface 12 of the fibrous structure 10 and thus a portion of the continuous unified design feature 26 may be present on two or more different portions, a first portion 30 and a second portion 32, of the surface 12 of the fibrous structure 10. The amount of the first zone 22 and/or continuous unified design feature 26 present on the surface 12 depends upon the scale of the aesthetics and/or texture, which the continuous unified design feature 26 of the first zone 22 and the design feature 16, which may be a discontinuous unified design feature 28, of the second zone 24 present on the surface 12 and the orientation thereof.

In FIGS. 2 and 3, a visibly discernible boundary between the first zone 22 and the second zone 24 is defined by at least a partial perimeter of the continuous unified design element 26, for example the continuous unified design element line element embossments that form one or more borders along the length of the continuous unified design feature 26.

In one example, the first zone 22 and second zone 24 may be present between two of the others on the surface 12 of the fibrous structure 10 as shown in FIGS. 2 and 3.

In one example, additional zones, such as a third zone (not shown), may be present on the surface 12 of the fibrous structure 10. The additional zones, for example may comprise different design features from the design features present in the first zone 22 and second zone 24. In one example, at least one or more of the additional zones may independently comprise a continuous unified design feature 26 or a discontinuous unified design feature 28.

The second zone 24 may comprise one or more second design features 16, which may be discontinuous unified design features 28, and optionally, one or more third design features 18, which may be discontinuous unified design features, and optionally one or more fourth design features 20, which may be discontinuous unified design features 28. In one example, the second zone 24 and/or discontinuous unified design feature 28 comprises ink. Any of the discontinuous unified design features 28 of the second zone 24 may be an embossed and/or printed via ink design feature.

As can be seen in FIGS. 2 and 3, the first design feature 14 is a continuous unified design feature 26 that exhibits a repeat unit, in the MD or substantially the MD of greater than 4 inches and/or greater than 5 inches and/or greater than 5.5 inches and/or greater than 6 inches and/or greater than 6.5 inches and/or greater than 7 inches and/or greater than 7.5 inches and/or greater than 8 inches.

The continuous unified design feature 26, in the case of FIG. 2, comprises one or more continuous unified design feature embossments. At least one of the one or more continuous unified design feature embossments is selected from the group consisting of: continuous unified design feature line element embossments 34, first continuous unified design feature dot element embossments 36, and mixtures thereof. In one example, at least one of the one or more continuous unified design feature embossments comprises at least one continuous unified design feature line element embossment 34, for example about 100% continuous unified design feature line element embossments 34. In one example, at least one continuous unified design feature line element embossment 34 defines a boundary between the first zone 22 and the second zone 24. In one example, at least 10% and/or at least 25% and/or at least 50% and/or at least 75% and/or at least 90% and/or at least 95% and/or at least 98% and/or about 100% of the surface's 12 surface area covered by the continuous unified design feature 26 is void of discrete dot element embossments 36.

In one example, the first zone 22 and/or the continuous unified design feature 26 and/or the second zone 24 and/or the discontinuous unified design feature 28 comprises a letter, word, logo, brand insignia, for example a letter embossment, word embossment, logo embossment, brand insignia embossment and/or a printed via ink letter, printed via ink word, printed via ink logo, and/or printed via ink brand insignia.

As shown in FIGS. 2 and 3, the second design feature 16 is a discontinuous unified design feature 28. The second zone 24 may comprise a plurality discontinuous unified design features 28. In one example, the plurality of discontinuous unified design features 28 exhibit Gestalt Principle Proximity (Grouping). In one example, the plurality of discontinuous unified design features 28 are discrete and separate from one another and from other design features on the surface 12, for example the first design feature 14.

Figure 6:
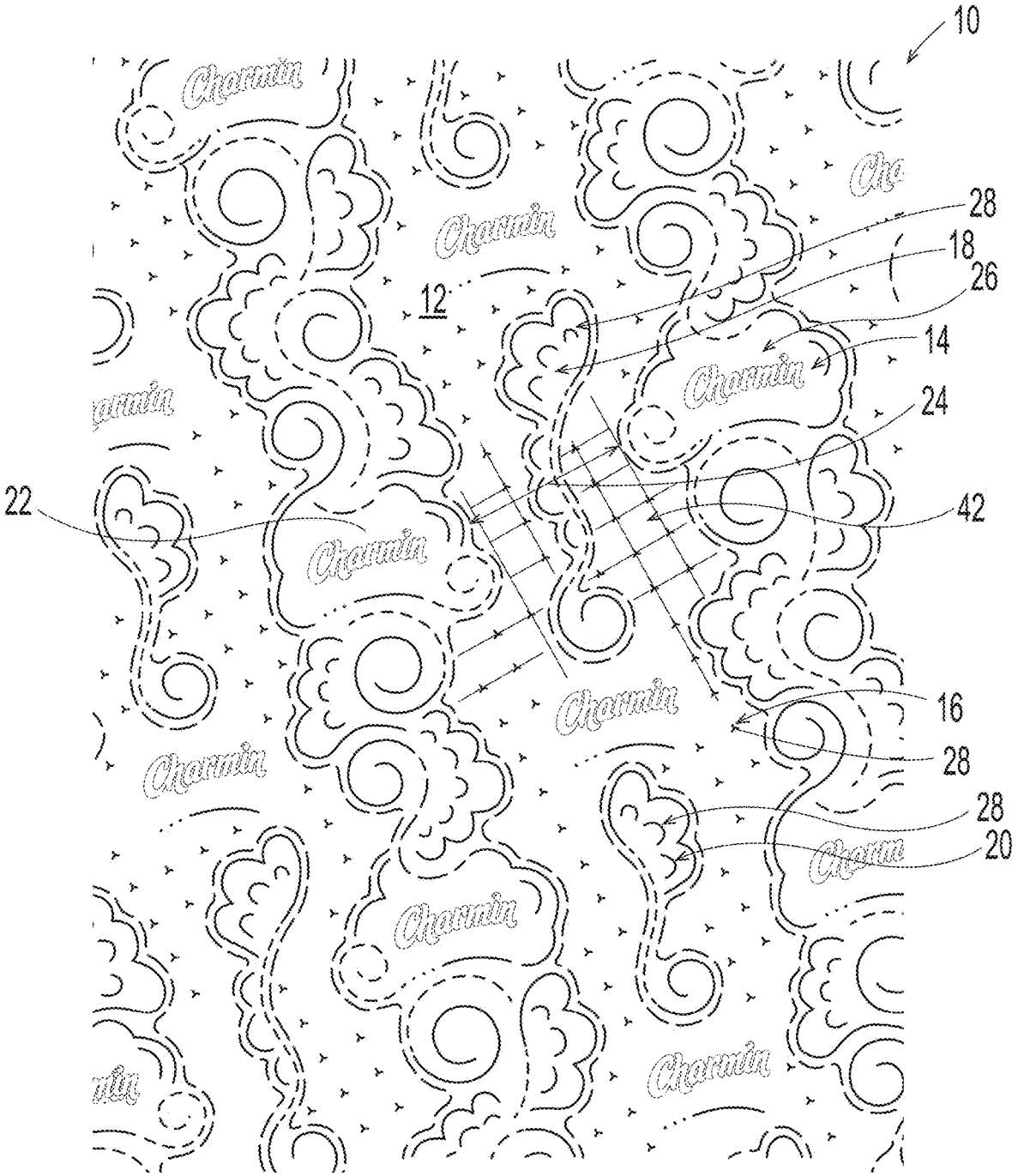
FIG. 6 is a schematic representation of a broader field of view of another example aesthetics present on a fibrous structure.

In one example, the discontinuous unified design features 28 may comprise one or more discontinuous unified design feature embossments, which may be selected from the group consisting of: discontinuous unified design feature line element embossments 38, discontinuous unified design feature dot element embossments 40, and mixtures thereof. In one example, the discontinuous unified design feature 28 of the second design feature 16 comprises a plurality of discontinuous unified design feature dot element embossments 40. In one example, one or more of the discontinuous unified design feature dot element embossments 40 may comprise a single embossment, such as a single dot embossment 40, or a plurality of embossments, which may themselves be single dot element embossments 40, that are closely arranged and similar to each other such that when viewed they are perceived as a single whole under the Gestalt Principle Proximity (Grouping). In another example the discontinuous unified design feature 28 of the second design feature 16 may be present in the form of a mesh and/or network 42 or even non-intersecting lines of a mesh and/or network 42 as shown FIG. 6 or at least a partial mesh and/or network.

In one example, the second zone 24 comprises one or more, for example a plurality of, first discontinuous unified design features 28. At least one and/or two or more and/or three or more of the first discontinuous unified design features 28 comprises one or more first discontinuous unified design feature embossments. In one example, the second zone 24 comprises one or more, for example a plurality of, second discontinuous unified design features 28. The second zone 24 may comprise one or more, for example a plurality of, second discontinuous unified design features 28 that are different from one or more, for example a plurality of, for example all of, the first discontinuous unified design features 28.

The dot element embossments of the present invention when present, especially those of the discontinuous unified design feature 28 of the second design feature 16 may be any shape and/or size and/or color and/or texture, such as a regular shape or irregular shape, which may be an embossment. In one example, the discontinuous unified design feature 28 of the second design feature 16 may independently be a geometric shape, such as a circle, polygon, ellipse, trilobe, cloverleaf, and star. In one example, the discontinuous unified design feature 28 of the second design feature 16 may independently be a non-geometric shape. In one example, the discontinuous unified design feature 28 of the second design feature 16 may independently be atomistic.

In one example, a plurality of the discontinuous unified design features 28 of the second design feature 16 are separated from each other such that one discontinuous unified design feature 28 is spaced from its closest adjacent discontinuous unified design feature(s) by a distance of at least 0.1" to less than 4" and/or at least 0.1" to less than 3" and/or at least 0.1" to less than 2" and/or at least 0.2" to about 1.75".

In one example, a plurality of the discontinuous unified design features 28 of the second design feature 16 are present in the second zone 24 on the surface 12 of the fibrous structure 10 at a concentration of at least $0.0625/in^2$ and/or at least $0.5/in^2$ and/or at least $1.0/in^2$ and/or at least $5.0/in^2$ and/or at least $9.0/in^2$ and/or at least $15.0/in^r$ and/or at least $20.0/in^2$ and/or at least $25.0/in^2$ and/or at least $0.0625/in^2$ to about $25.0/in^2$ and/or at least $0.5/in^2$ to about $25.0/in^2$ and/or at least $1.0/in^2$ to about $20.0/in^2$ and/or at least $5.0/in^2$ to about $9.0/in^2$.

In one example, a plurality of the discontinuous unified design features 28 of the second design feature 16, for example three or more, are arranged on the surface 12 of the fibrous structure 10 in a regular pattern, for example in an orthogonal pattern.

In one example, the first zone 22 and the second zone 24 occupy different parts of the surface's surface area along the fibrous structure's length, for example its MD length.

In one example, the first zone 22 covers greater than 15% and/or greater than 20% and/or greater than 30% and/or greater than 40% and/or at least 45% and/or at least 50% of the fibrous structure's surface's 12 surface area.

Making Fibrous Structures of the Present Invention

The sanitary tissue products and webs ("fibrous structures") of the present invention may be made by any suitable papermaking process so long as the sanitary tissue products include a surface comprising aesthetics and/or print via ink that exhibits one or more and/or two or more and/or three or more and/or four or more and/or five or more and/or six or more of the Gestalt Principles according to the present invention. For example, the webs may be made by wet-laid and/or air-laid and/or co-form processes. Non-limiting examples of suitable wet-laid processes include through-air-drying (creped and uncreped) process, belt creped process, fabric creped process, NTT process, ATMOS process, conventional wet pressed process, and mixtures thereof.

The papermaking process may be a sanitary tissue product making process that uses a cylindrical dryer such as a Yankee (a Yankee-process) or it may be a Yankeeless process (for example an uncreped through-air-dried or UCTAD) as is used to make substantially uniform density. Alternatively, the webs and/or sanitary tissue products may be made by an air-laid process and/or meltblown and/or spunbond processes and/or co-forming process and any combinations thereof so long as the sanitary tissue products and/or fibrous structures of the present invention are made from the webs (fibrous structures) of the present invention.

In one example, the sanitary tissue products and/or fibrous structures of the present invention, for example a single-ply or multi-ply sanitary tissue products and/or fibrous structures, in this case a multi-ply sanitary tissue product roll may be made by combining and/or marrying, such as by plybonding with an adhesive (chemically), such as a plybond glue, for example a polyvinylalcohol-based glue, or knurling (mechanically) via knurling wheels, two or more webs (fibrous structures) together to form a multi-ply sanitary tissue product and then ultimately winding the multi-ply sanitary tissue product into a multi-ply sanitary tissue product roll as follows. Two or more parent rolls of a web (fibrous structure) of the present invention are converted into a sanitary tissue product roll by loading each roll of web (fibrous structure) into an unwind stand. In one example, the line speed may be from about 200 ft/min to about 800 ft/min and/or from about 200 ft/min to about 600 ft/min and/or from about 300 ft/min to about 500 ft/min and/or about 400 ft/min. One parent roll of the web (fibrous structure) is unwound and transported to an emboss nip (patterned steel roll and a rubber roll) where the web (fibrous structure) is strained to form an emboss pattern in the web (fibrous structure). The embossed web is then combined and married with the web (fibrous structure) from the other parent roll to make a multi-ply (2-ply) sanitary tissue product. The multi-ply sanitary tissue product is then transported over a slot extruder through which a surface chemistry, for example a surface softening agent, may be applied. The multi-ply sanitary tissue product is then transported to a winder, for example a surface winder or a drum rewinder or center winder, in one example a surface winder, passing through a perforating station at a speed of from about 75 ft/min to about 400 ft/min and/or from about 100 ft/min to about 300 ft/min and/or from about 150 ft/min to about 225 ft/min, on its way to the winder to impart a plurality of perforations into the multi-ply sanitary tissue product at about every 4 inches resulting in about 850 sheets in the multi-ply sanitary tissue product. After the perforating station, the multi-ply sanitary tissue product is wound onto a core having an outer diameter of about 1.65 inches such that a log from which the finished sanitary tissue product rolls as described below are made is formed. In one example, the surface winder runs at a speed the same as the line speed above or faster, for example from about 200 ft/min to about 1000 ft/min and/or from about 300 ft/min to about 800 ft/min and/or from about 300 ft/min to about 700 ft/min and/or about 600 ft/min. In one example, the log runs through a tail sealing operation to seal the tail of the multi-ply sanitary tissue product. The log of multi-ply sanitary tissue product is then transported to a log saw where the log is cut into finished multi-ply sanitary tissue product rolls.

In another example, the sanitary tissue products and/or fibrous structures of the present invention, for example a single-ply or multi-ply sanitary tissue products and/or fibrous structures, in this case a multi-ply sanitary tissue product roll may be made by combining and/or marrying, such as by plybonding with an adhesive (chemically), such as a plybond glue, for example a polyvinylalcohol-based glue, or knurling (mechanically) via knurling wheels, two or more webs (fibrous structures) together to form a multi-ply sanitary tissue product and then ultimately winding the multi-ply sanitary tissue product into a multi-ply sanitary tissue product roll as follows. A pre-combined/pre-married and optionally embossed and/or optionally surface softened multi-ply sanitary tissue product parent roll may be converted into a finished sanitary tissue product roll by loading the pre-combined/pre-married multi-ply sanitary tissue product parent roll into an unwind stand. In one example, the line speed may be from about 200 ft/min to about 800 ft/min and/or from about 200 ft/min to about 600 ft/min and/or from about 300 ft/min to about 500 ft/min and/or about 400 ft/min. The pre-combined/pre-married multi-ply sanitary tissue product parent roll is unwound and transported to a winder, for example a surface winder or a drum rewinder or center winder, in one example a surface winder, passing through a perforating station at a speed of from about 75 ft/min to about 400 ft/min and/or from about 100 ft/min to about 300 ft/min and/or from about 150 ft/min to about 225 ft/min, on its way to the winder to impart a plurality of perforations into the pre-combined/pre-married multi-ply sanitary tissue product at about every 4 inches resulting in about 850 sheets in the pre-combined/pre-married multi-ply sanitary tissue product. After the perforating station, the pre-combined/pre-married multi-ply sanitary tissue product is wound onto a core having an outer diameter of about 1.65 inches such that a log from which the finished sanitary tissue product rolls as described below are made is formed. In one example, the surface winder runs at a speed the same as the line speed above or faster, for example from about 200 ft/min to about 1000 ft/min and/or from about 300 ft/min to about 800 ft/min and/or from about 300 ft/min to about 700 ft/min and/or about 600 ft/min. In one example, the log runs through a tail sealing operation to seal the tail of the pre-combined/pre-married multi-ply sanitary tissue product. The log of pre-combined/pre-married multi-ply sanitary tissue product is then transported to a log saw where the log is cut into finished multi-ply sanitary tissue product rolls.

The fibrous structures and/or sanitary tissue products of the present invention may comprise a structured fibrous structure. In one example, the structured fibrous structure may comprise aesthetics and/or print via ink that exhibits Gestalt Principles according to the present invention. For example, the structured fibrous structure of the present invention may comprise a surface that comprises one or more design features arranged on the surface using one or more and/or two or more and/or three or more and/or four or more and/or five or more and/or six or more of the Gestalt Principles according to the present invention.

In one example, the fibrous structure of the present invention is a structured fibrous structure. For example, the structured fibrous structure comprises a molded microscopical three-dimensional pattern, which may for example be imparted by a through-air-drying fabric and/or a patterned resin-containing belt and/or a patterned resin-containing fabric.

The molded microscopical three-dimensional pattern may comprise a semi-continuous network of pillows and knuckles and/or a continuous pillow network and discrete knuckles dispersed throughout the continuous pillow network and/or a continuous knuckle network and discrete pillows dispersed throughout the continuous knuckle network.

The structured fibrous structure may comprise a through-air-dried fibrous structure ply, for example a creped through-air-dried fibrous structure ply and/or an uncreped through-air-dried fibrous structure ply.

The structured fibrous structure may comprise a fabric creped fibrous structure ply.

The structured fibrous structure may comprise a belt creped fibrous structure ply.

The structured fibrous structure may comprise an ATMOS fibrous structure ply.

The structured fibrous structure may comprise an NTT fibrous structure ply.

The structure fibrous structure may comprise a QRT fibrous structure ply.

The fibrous structure and/or sanitary tissue product of the present invention may comprise a single embossed fibrous structure ply according to the present invention or two or more embossed fibrous structure plies according to the present invention, for example both fibrous structure plies of a two-ply product may be embossed.

In one example of the present invention, the fibrous structure comprises a plurality of fibers, for example pulp fibers, such as wood pulp fibers.

In another example, the fibrous structure comprises a plurality of filaments.

In still another example, the fibrous structure comprising a plurality of fibers and filaments, for example a co-formed fibrous structure.

In addition to the above examples of the present invention, a molding member may be used to make a fibrous structure of the present invention so long as the fibrous structure exhibits the Gestalt Principles described herein. A "molding member" is a structural element that can be used as a support for an embryonic web comprising a plurality of fibrous elements, for example fibers and/or filaments, such as plurality of cellulosic fibers and/or a plurality of synthetic fibers, as well as a forming unit to form, or "mold," a desired microscopical geometry of the fibrous structure of the present invention such that the aesthetics from the molding member, for example pattern, imparted to a surface of the fibrous structure and one or more aesthetics and/or texture imparted to the surface of the fibrous structure via embossing and/or print via ink exhibit the Gestalt Principles described herein, for example the molding member imparts the Gestalt Principle Ground and embossing imparts the Gestalt Principle Figure.

The molding member may comprise any element that has fluid-permeable areas and the ability to impart a microscopical three-dimensional pattern to the structure being produced thereon, and includes, without limitation, single-layer and multi-layer structures comprising a stationary plate, a belt, a woven fabric (including Jacquard-type and the like woven patterns), a band, and a roll. In one example, the molding member is a deflection member.

A "reinforcing element" is a desirable (but not necessary) element in some embodiments of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

In one example of a method for making a fibrous structure of the present invention, the method comprises the step of contacting an embryonic fibrous web with a deflection member (molding member) such that at least one portion of the embryonic fibrous web is deflected out-of-plane of another portion of the embryonic fibrous web. The phrase "out-of-plane" as used herein means that the fibrous structure comprises a protuberance, such as a dome, or a cavity that extends away from the plane of the fibrous structure. The molding member may comprise a through-air-drying fabric having its filaments arranged to produce linear elements within the fibrous structures of the present invention and/or the through-air-drying fabric or equivalent may comprise a resinous framework that defines deflection conduits that allow portions of the fibrous structure to deflect into the conduits thus forming linear elements within the fibrous structures of the present invention. In addition, a forming wire, such as a foraminous member may be arranged such that linear elements within the fibrous structures of the present invention are formed and/or like the through-air-drying fabric, the foraminous member may comprise a resinous framework that defines deflection conduits that allow portions of the fibrous structure to deflect into the conduits thus forming linear elements within the fibrous structures of the present invention.

In another example of a method for making a fibrous structure of the present invention, the method comprises the steps of:

(a) providing a fibrous furnish comprising fibers; and
(b) depositing the fibrous furnish onto a deflection member such that at least one fiber is deflected out-of-plane of the other fibers present on the deflection member.

In still another example of a method for making a fibrous structure of the present invention, the method comprises the steps of:

(a) providing a fibrous furnish comprising fibers;
(b) depositing the fibrous furnish onto a foraminous member to form an embryonic fibrous web;
(c) associating the embryonic fibrous web with a deflection member such that at least one fiber is deflected out-of-plane of the other fibers present in the embryonic fibrous web; and
(d) drying said embryonic fibrous web such that that the dried fibrous structure is formed.

In another example of a method for making a fibrous structure of the present invention, the method comprises the steps of:

(a) providing a fibrous furnish comprising fibers;

(b) depositing the fibrous furnish onto a first foraminous member such that an embryonic fibrous web is formed;

(c) associating the embryonic web with a second foraminous member which has one surface (the embryonic fibrous web-contacting surface) comprising a macroscopically monoplanar network surface which is continuous and patterned and which defines a first region of deflection conduits and a second region of deflection conduits within the first region of deflection conduits;

(d) deflecting the fibers in the embryonic fibrous web into the deflection conduits and removing water from the embryonic web through the deflection conduits so as to form an intermediate fibrous web under such conditions that the deflection of fibers is initiated no later than the time at which the water removal through the deflection conduits is initiated; and (e) optionally, drying the intermediate fibrous web; and (f) optionally, foreshortening the intermediate fibrous web.

The fibrous structures of the present invention may be made by a method wherein a fibrous furnish is applied to a first foraminous member to produce an embryonic fibrous web. The embryonic fibrous web may then come into contact with a second foraminous member that comprises a deflection member to produce an intermediate fibrous web that comprises a network surface and at least one dome region. The intermediate fibrous web may then be further dried to and then embossed and/or printed via ink form a surface of the fibrous structure that exhibits the Gestalt Principles herein described.

In one example, the fibrous structures of the present invention may comprise a molded pattern, for example three-dimensional pattern, imparted to a surface of the fibrous structures via a molding member and aesthetics via embossing and/or print via ink imparted to the surface of the fibrous structures that exhibit the Gestalt Principles with respect to the molded pattern and the further embossing and/or print and/or the aesthetics via embossing and/or print via ink imparted to the surface exhibits Gestalt Principles as described herein.

Non-Limiting Example for Making Fibrous Structures/Sanitary Tissue Products of the Present Invention The following Example illustrates a non-limiting example for a preparation of a sanitary tissue product comprising a web comprising a fibrous structure ply according to the present invention made on a pilot-scale Fourdrinier fibrous structure making (papermaking) machine.

An aqueous slurry of eucalyptus (Suzano, formerly Fibria, Brazilian bleached hardwood kraft pulp) pulp fibers is prepared at about 3% fiber by weight using a conventional repulper, then transferred to the hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and equally distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% eucalyptus slurry is then directed and distributed to the center chamber of a multi-layered, three-chambered headbox of a Fourdrinier wet-laid papermaking machine.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 38% of the top side is made up of the eucalyptus fibers, about 38% is made of the eucalyptus fibers on the bottom side and about 24% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 750 feet per minute (fpm).

The embryonic wet fibrous structure is transferred from the Fourdrinier wire, at a fiber consistency of about 15% at the point of transfer, to a 3D patterned through-air-drying belt. The speed of the 3D patterned through-air-drying belt is the same as the speed of the Fourdrinier wire. The 3D patterned through-air-drying belt is designed to yield a fibrous structure comprising a pattern of high density knuckle regions dispersed throughout a multi-elevational continuous pillow region. The multi-elevational continuous pillow region comprises an intermediate density pillow region (density between the high density knuckles and the low density other pillow region) and a low density pillow region formed by the deflection conduits created by the semi-continuous knuckle layer substantially oriented in the machine direction. The supporting fabric of the 3D patterned through-air-drying belt is a 98×52 filament, dual layer fine mesh. The thickness of the first layer resin cast of the belt is about 6 mils above the supporting fabric and the thickness of the second layer resin cast of the belt is about 13 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 53% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Hercules Incorporated of Wilmington, Del. The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 757 fpm.

Figure 7:
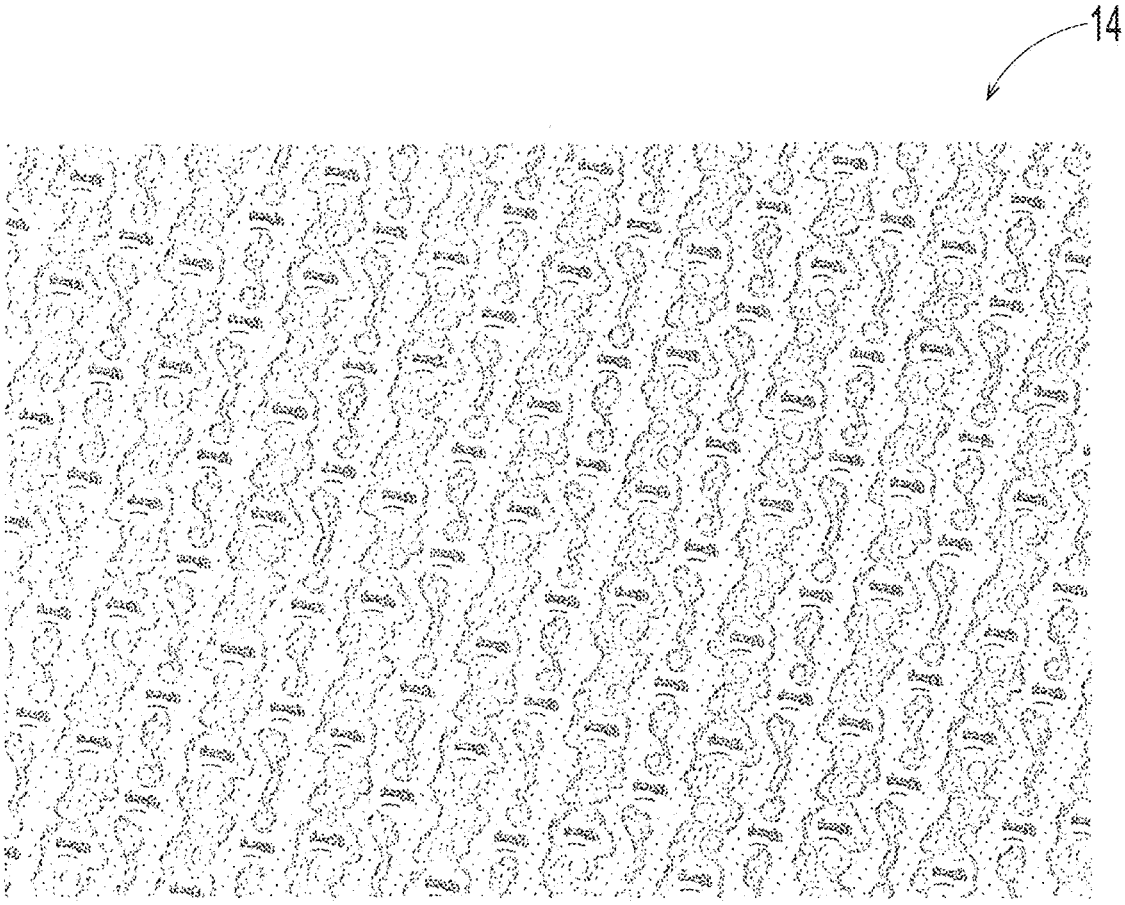
FIG. 7 is a schematic representation of a pattern for an emboss roll suitable for making the fibrous structures of the present invention, wherein the emboss pattern imparted to the fibrous structure is the mirror image of the pattern on the emboss roll.

Two parent rolls of the web (fibrous structure) are then converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form an emboss pattern, as partially shown in FIG. 3, in the web (fibrous structure) using an emboss roll 44 as shown in FIG. 7, and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 850 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a width of about 3.8 inches to about 4.25 inches of the multi-ply sanitary tissue product comprising a fibrous structure as shown in FIG. 2.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products unless otherwise stated. All tests are conducted in such conditioned room. Do not test samples that have defects such as wrinkles, tears, holes, and like. All instruments are calibrated according to manufacturer's specifications.

Basis Weight Test Method for Toilet Tissue Samples

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in ±0.007 in by 3.500 in ±0.007 in is used to prepare all samples.

Stack six usable units aligning any perforations or folds on the same side of stack. With a precision cutting die, cut the stack into squares. Select six more usable units of the sample; stack and cut in like manner Combine the two stacks to form a single stack twelve squares thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1layer in stack)×(Number of layers)]

For example,

Basis Weight($lbs/3000ft^2$)=[[Mass of stack($g$)/453.6 ($g/lbs$)]/[12.25($in^2$)/144($in^2/ft^2$)×12]]×3000

Or,

Basis Weight($g/m^2$)=Mass of stack($g$)/[79.032($cm^2$)/10,000($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Basis Weight Test Method for Paper Towel Samples

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 4.000 in ±0.008 in by 4.000 in±0.008 in is used to prepare all samples.

Stack eight usable units aligning any perforations or folds on the same side of stack. With a precision cutting die, cut the stack into squares. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1layer in stack)×(Number of layers)]

For example,

Basis Weight($lbs/3000ft^2$)=[[Mass of stack($g$)/453.6 ($g/lbs$)]/[16($in^2$)/144($in^2/ft^2$)×8]]×3000

Or,

Basis Weight($g/m^2$)=Mass of stack($g$)/[103.23($cm^2$)/10,000($cm^2/m^2$)×8]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Caliper Test Method

Caliper of a sanitary tissue product or web is measured using a ProGage Thickness Tester (Thwing-Albert Instrument Company, West Berlin, N.J.) with a pressure foot diameter of 2.00 inches (area of 3.14 $in^2$) at a pressure of 95 $g/in^2$. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 $g/in^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Dry Tensile Strength Test Method for Toilet Tissue Samples

Elongation, Tensile Strength, TEA and Tangent Modulus are measured on a constant rate of extension tensile tester with computer interface (a suitable instrument is the EJA Vantage from the Thwing-Albert Instrument Co. West Berlin, N.J.) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of sanitary tissue product or web are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as g*in/in$^2$ to the nearest 1 g*in/in$^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA (g*in/in$^2$) and Tangent Modulus (g/cm) are calculated for the four CD specimens and the four MD specimens. Calculate an average for each parameter separately for the CD and MD specimens.

Calculations:

Geometric Mean Tensile=Square Root of[*MD*Tensile Strength(*g*/in)×*CD*Tensile Strength(*g*/in)]

Geometric Mean Peak Elongation=Square Root of[*MD* Elongation (%)×*CD* Elongation (%)]

Geometric Mean*TEA*=Square Root of[*MD TEA*(*g**in/in$^2$)×*CD TEA*(*g**in/in$^2$)]

Geometric Mean Modulus=Square Root of[*MD* Modulus(*g/cm*)×*CD* Modulus(*g/cm*)]

TotalDry Tensile Strength(*TDT*)=*MD* Tensile Strength(*g*/in)+*CD* Tensile Strength(*g*/in)

Total*TEA*=*MD TEA*(*g**in/in$^2$)+*CD TEA*(*g**in/in$^2$)

Total Modulus=*MD* Modulus(*g/cm*)+*CD* Modulus(*g/cm*)

Tensile Ratio=*MD* Tensile Strength(*g*/in)/*CD* Tensile Strength(*g*/in)

Dry Tensile Strength Test Method for Paper Towel Samples

Elongation, Tensile Strength, TEA and Tangent Modulus are measured on a constant rate of extension tensile tester with computer interface (a suitable instrument is the EJA Vantage from the Thwing-Albert Instrument Co. West Berlin, N.J.) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of sanitary tissue product or web are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 5.0 in long stack of strips (long dimension in CD). In like fashion cut the remaining stack in the MD (strip long dimension in MD), to give a total of 8 specimens, four CD and four MD strips. Each strip to be tested is one usable unit thick and will be treated as a unitary specimen for testing.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 4.00 inches. Zero the crosshead and load cell. Insert the specimen into the upper and lower open grips such that at least 0.5 inches of specimen length is contained each grip. Align specimen vertically within the upper and lower jaws, then close the upper grip.

Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the specimen width (1 in), and reported as g/in to the nearest 1 Win.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in) and specimen width (in). This is reported as g*in/in$^2$ to the nearest 1 g*in/in$^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 38.1 g force and the 5 data points immediately preceding and the 5 data points immediately following it. This slope is then divided by the specimen width (2.54 cm), and then reported to the nearest 1 g/cm.

The Tensile Strength (g/in), Elongation (%), TEA (g*in/in$^2$) and Tangent Modulus (g/cm) are calculated for the four CD specimens and the four MD specimens. Calculate an average for each parameter separately for the CD and MD specimens.

Calculations:

Geometric Mean Tensile=Square Root of[*MD* Tensile Strength(*g*/in)×*CD* Tensile Strength(*g*/in)]

Geometric Mean Peak Elongation=Square Root of[*MD* Elongation (%)×*CD* Elongation (%)]

Geometric Mean*TEA*=Square Root of[*MD TEA*(*g**in/in$^2$)×*CD TEA*(*g**in/in$^2$)]

Geometric Mean Modulus=Square Root of[*MD* Modulus(*g/cm*)×*CD* Modulus(*g/cm*)]

TotalDry Tensile Strength(*TDT*)=*MD* Tensile Strength(*g*/in)+*CD* Tensile Strength(*g*/in)

Total*TEA*=*MD TEA*(*g**in/in$^2$)+*CD TEA*(*g**in/in$^2$)

Total Modulus=*MD* Modulus(*g/cm*)+*CD* Modulus(*g/cm*)

Tensile Ratio=*MD* Tensile Strength(*g*/in)/*CD* Tensile Strength(*g*/in)

Wet Tensile Test Method

The Wet Tensile Strength test method is utilized for the determination of the wet tensile strength of a sanitary tissue product or web strip after soaking with water, using a tensile-strength-testing apparatus operating with a constant rate of elongation. The Wet Tensile Strength test is run according to ISO 12625-5:2005, except for any deviations or modifications described below. This method uses a vertical tensile-strength tester, in which a device that is held in the lower grip of the tensile-strength tester, called a Finch Cup, is used to achieve the wetting.

Using a one inch JDC precision sample cutter (Thwing Albert) cut six 1.00 in±0.01 in wide strips from a sanitary tissue product sheet or web sheet in the machine direction (MD), and six strips in the cross machine direction (CD). An electronic tensile tester (Model 1122, Instron Corp., or equivalent) is used and operated at a crosshead speed of 1.0 inch (about 1.3 cm) per minute and a gauge length of 1.0 inch (about 2.5 cm). The two ends of the strip are placed in the upper jaws of the machine, and the center of the strip is placed around a stainless steel peg. The strip is soaked in distilled water at about 20° C. for the identified soak time, and then measured for peak tensile strength. Reference to a machine direction means that the sample being tested is prepared such that the length of the strip is cut parallel to the machine direction of manufacture of the product.

The MD and CD wet peak tensile strengths are determined using the above equipment and calculations in the conventional manner. The reported value is the arithmetic average of the six strips tested for each directional strength to the nearest 0.1 grams force. The total wet tensile strength for a given soak time is the arithmetic total of the MD and CD tensile strengths for that soak time. Initial total wet tensile strength ("ITWT") is measured when the paper has been submerged for 5±0.5 seconds. Decayed total wet tensile ("DTWT") is measured after the paper has been submerged for 30±0.5 minutes.

Wet Decay Test Method

Wet decay (loss of wet tensile) for a sanitary tissue product or web is measured according to the Wet Tensile Test Method described herein and is the wet tensile of the sanitary tissue product or web after it has been standing in the soaked condition in the Finch Cup for 30 minutes. Wet decay is reported in units of "%". Wet decay is the % loss of Initial Total Wet Tensile after the 30 minute soaking.

Dry Burst Test Method

The Dry Burst Test is run according to ISO 12625-9:2005, except for any deviations described below. Sanitary tissue product samples or web samples for each condition to be tested are cut to a size appropriate for testing, a minimum of five (5) samples for each condition to be tested are prepared.

A burst tester (Burst Tester Intelect-II-STD Tensile Test Instrument, Cat. No. 1451-24PGB available from Thwing-Albert Instrument Co., Philadelphia, Pa., or equivalent) is set up according to the manufacturer's instructions and the following conditions: Speed: 12.7 centimeters per minute; Break Sensitivity: 20 grams; and Peak Load: 2000 grams. The load cell is calibrated according to the expected burst strength.

A sanitary tissue product sample or web sample to be tested is clamped and held between the annular clamps of the burst tester and is subjected to increasing force that is applied by a 0.625 inch diameter, polished stainless steel ball upon operation of the burst tester according to the manufacturer's instructions. The burst strength is that force that causes the sample to fail.

The burst strength for each sanitary tissue product sample or web sample is recorded. An average and a standard deviation for the burst strength for each condition is calculated.

The Dry Burst is reported as the average and standard deviation for each condition to the nearest gram.

Wet Burst Test Method

"Wet Burst Strength" as used herein is a measure of the ability of a sanitary tissue product or web to absorb energy, when wet and subjected to deformation normal to the plane of the sanitary tissue product or web. The Wet Burst Test is run according to ISO 12625-9:2005, except for any deviations or modifications described below.

Wet burst strength may be measured using a Thwing-Albert Burst Tester Cat. No. 177 equipped with a 2000 g load cell commercially available from Thwing-Albert Instrument Company, Philadelphia, Pa., or an equivalent instrument.

Wet burst strength is measured by preparing four (4) sanitary tissue product samples or web samples for testing. First, condition the samples for two (2) hours at a temperature of 73° F.±2° F. (23° C.±1° C.) and a relative humidity of 50% (±2%). Take one sample and horizontally dip the center of the sample into a pan filled with about 25 mm of room temperature distilled water. Leave the sample in the water four (4) (±0.5) seconds. Remove and drain for three (3) (±0.5) seconds holding the sample vertically so the water runs off in the cross machine direction. Proceed with the test immediately after the drain step.

Place the wet sample on the lower ring of the sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise (or lower) toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest gram.

Figure 8:
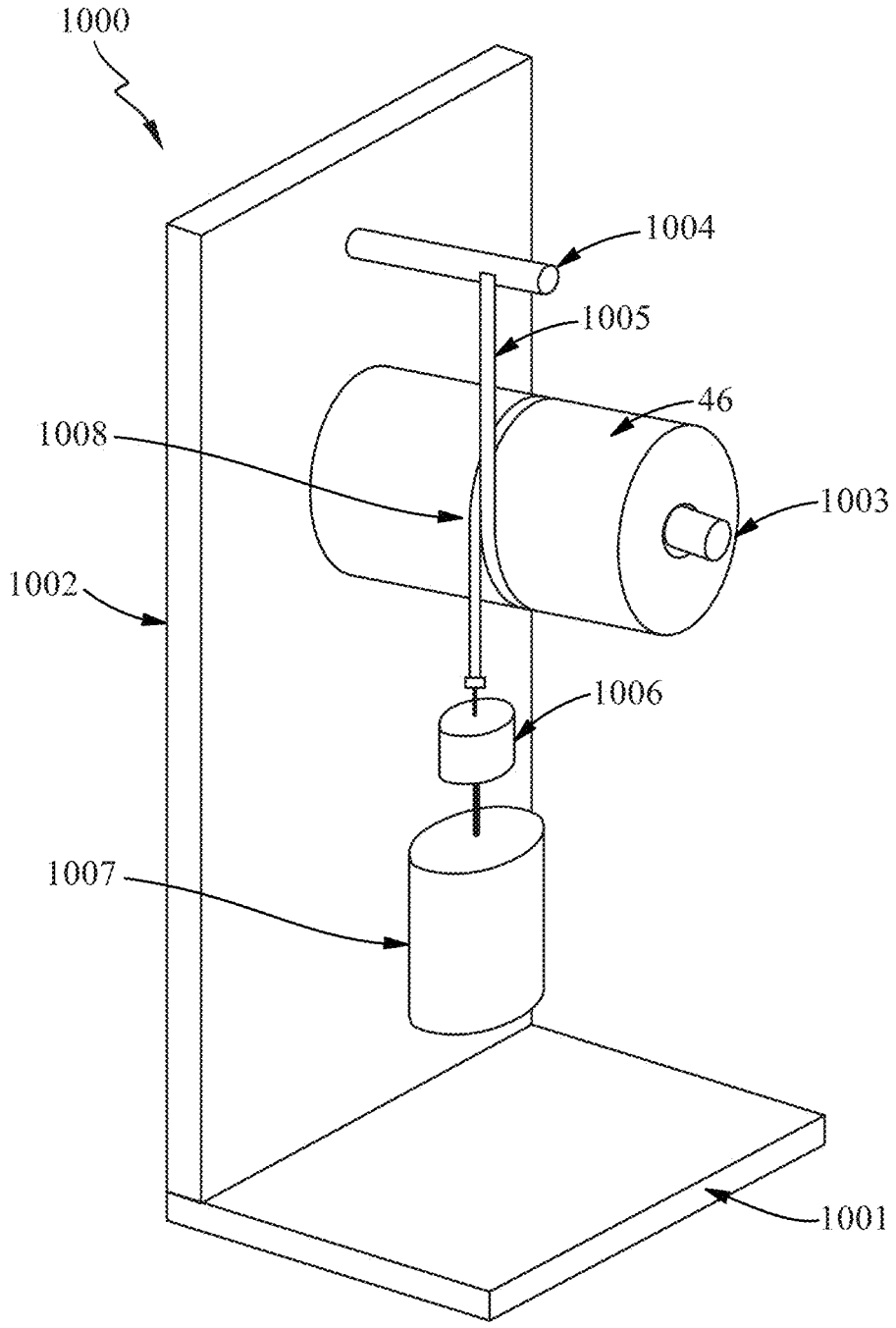
FIG. 8 is a schematic representation of the testing device used in the Roll Compressibility Test Method described herein.

Percent Compressibility Test Method for Toilet Tissue Roll and Paper Towel Roll Samples Percent Roll Compressibility (Percent Compressibility) is determined using the Roll Tester 1000 as shown in FIG. 8. It is comprised of a support stand made of two aluminum plates, a base plate 1001 and a vertical plate 1002 mounted perpendicular to the base, a sample shaft 1003 to mount the test roll, and a bar 1004 used to suspend a precision diameter tape 1005 that wraps around the circumference of the test roll. Two different weights 1006 and 1007 are suspended from the diameter tape to apply a confining force during the uncompressed and compressed measurement. All testing is performed in a conditioned room maintained at about 23° C.±2° C. and about 50%±2% relative humidity.

The diameter of the test roll, for example a sanitary tissue product roll 46, is measured directly using a Pi® tape or equivalent precision diameter tape (e.g. an Executive Diameter tape available from Apex Tool Group, LLC, Apex, N.C., Model No. W606PD) which converts the circumferential distance into a diameter measurement, so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary the diameter tape is shortened from its original length to a length that allows both of the attached weights to hang freely during the test yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the roll and longer than the width of the roll. A small steal bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2° C. and about 50%±2% relative humidity for 2 hours prior to testing. Rolls with cores that are crushed, bent or damaged should not be tested. Place the test roll on the sample shaft 1003 such that the direction the paper was rolled onto its core is the same direction the diameter tape will be wrapped around the test roll. Align the midpoint of the roll's width with the suspended diameter tape. Loosely loop the diameter tape 1004 around the circumference of the roll, placing the tape edges directly adjacent to each other with the surface of the tape lying flat against the test sample. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again, read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\text{Original Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a surface comprising:

a. a first zone defined by one or more portions of a continuous unified design feature occupying at least a first part of the surface's surface area; and b. a second zone defined by at least a first portion of the remaining part of the surface's surface area not occupied by the first zone;

wherein a visually discernible boundary exists between the first zone and the second zone;

wherein the continuous unified design feature comprises one or more continuous unified design feature embossments at least one of which is selected from the group consisting of: continuous unified design feature line element embossments, continuous unified design feature dot element embossments, and mixtures thereof.

2. The fibrous structure according to claim 1 wherein at least one of the one or more continuous unified design feature embossments comprises at least one continuous unified design feature line element embossments.

3. The fibrous structure according to claim 2 wherein the at least one continuous unified design feature line element embossment defines a boundary between the first zone and the second zone.

4. The fibrous structure according to claim 1 wherein at least 10% of the surface's surface area covered by the continuous unified design feature is void of discrete dot element embossments.

5. The fibrous structure according to claim 1 wherein the first zone comprises one or more brand insignia.

6. The fibrous structure according to claim 1 wherein the second zone comprises one or more first discontinuous unified design features.

7. The fibrous structure according to claim 6 wherein at least one of the first discontinuous unified design features comprises one or more first discontinuous unified design feature embossments.

8. The fibrous structure according to claim 7 wherein at least one of the first discontinuous unified design features comprises two or more first discontinuous unified design feature embossments.

9. The fibrous structure according to claim 8 wherein the at least one of the first discontinuous unified design features comprises three of more first discontinuous unified design feature embossments.

10. The fibrous structure according to claim 6 wherein at least one of the first discontinuous unified design feature embossments is selected from the group consisting of: first discontinuous unified design feature line element embossments, first discontinuous unified design feature dot element embossments, and mixtures thereof.

11. The fibrous structure according to claim 6 wherein at least one first discontinuous unified design feature is separated from its closest adjacent first discontinuous unified design feature by a distance of at least 0.1" to less than 4".

12. The fibrous structure according to claim 1 wherein the second zone further comprises a brand insignia.

13. The fibrous structure according to claim 1 wherein the first zone and second zone occupy different parts of the surface's surface area along the fibrous structure's length.

14. The fibrous structure according to claim 1 wherein the first zone is further defined by at least a second portion of the continuous unified design feature occupying a second part of the surface's surface area different from the first part.

15. A single- or multi-ply sanitary tissue product comprising a fibrous structure according to claim 1.

16. A roll of sanitary tissue product comprising a single- or multi-ply sanitary tissue product according to claim 15.

17. A package comprising one or more rolls of sanitary tissue product according to claim 15.

18. The package according to 17 wherein the package comprises a material selected from the group consisting of: film, paperboard, cardboard, compostable materials, biodegradable materials, and mixtures thereof.

* * * * *